US008062011B2

(12) United States Patent
Takeda et al.

(10) Patent No.: US 8,062,011 B2
(45) Date of Patent: Nov. 22, 2011

(54) COMPRESSOR HAVING AN EJECTOR OIL PUMP

(75) Inventors: Katsuyuki Takeda, Fujioka (JP); Dai Matsuura, Ota (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 450 days.

(21) Appl. No.: 12/293,467

(22) PCT Filed: Mar. 15, 2007

(86) PCT No.: PCT/JP2007/055217

§ 371 (c)(1),
(2), (4) Date: Sep. 18, 2008

(87) PCT Pub. No.: WO2007/114020

PCT Pub. Date: Oct. 11, 2007

(65) Prior Publication Data

US 2009/0280020 A1 Nov. 12, 2009

(30) Foreign Application Priority Data

Mar. 30, 2006 (JP) ..... 2006-094177

(51) Int. Cl.
*F03C 2/00* (2006.01)
*F03C 4/00* (2006.01)
*F04C 11/00* (2006.01)

(52) U.S. Cl. ..... 418/11; 418/60; 418/270; 285/325; 285/335

(58) Field of Classification Search ..... 418/11, 418/60, 63, 270, 88; 285/325, 330, 335, 285/339

See application file for complete search history.

(56) References Cited

U.S. PATENT DOCUMENTS 4,240,774 A * 12/1980 Ladusaw ..... 418/248
5,341,566 A * 8/1994 Quitschau et al. ..... 29/890.035

FOREIGN PATENT DOCUMENTS

| | | |
|---|---|---|
| JP | 53-119255 | 10/1978 |
| JP | 55-91792 | 7/1980 |
| JP | 55-170483 | 12/1980 |
| JP | 55-170484 | 12/1980 |

(Continued)

OTHER PUBLICATIONS

Japanese Office Action dated Jan. 8, 2010 (in Japanese).

(Continued)

*Primary Examiner* — Theresa Trieu
(74) *Attorney, Agent, or Firm* — Kratz, Quintos & Hanson, LLP

(57) ABSTRACT

A compressor includes an ejector oil pump which sucks the oil from an oil reservoir in the bottom part of a sealed container to an oil passage formed in a rotary shaft, and the ejector oil pump includes an oil suction pipe having one end connected to the oil passage and the other end which opens in the oil reservoir, and an ejector pipe having one end which communicates with the discharge side of a compressor mechanism portion and the other end inserted into the opening of the other end of the oil suction pipe to open. The inner diameter of the other end of the oil suction pipe is larger than the outer diameter of the other end of the ejector pipe, and the other end of the oil suction pipe is provided with first and second dowel portions which position the other end of the ejector pipe.

3 Claims, 5 Drawing Sheets

FOREIGN PATENT DOCUMENTS

| | | | |
|---|---|---|---|
| JP | 60-69291 | | 4/1985 |
| JP | 7-269534 | | 10/1995 |
| JP | 2005-36740 | | 2/2005 |
| JP | 2005-36740 | A1 | 2/2005 |

OTHER PUBLICATIONS

International Search Report for International Application No. PCT/JP2007/055217 dated May 23, 2007.

* cited by examiner

COMPRESSOR HAVING AN EJECTOR OIL PUMP

RELATED APPLICATIONS

This application is a 35 U.S.C. 371 application of International Application No. PCT/JP07/055217, filed Mar. 15, 2007, which application claims priority of Japanese Application No. 2006-94177, filed Mar. 30, 2006, the entire contents of which are incorporated herein by reference.

BACKGROUND OF THE INVENTION

The present invention relates to a compressor which discharges, into a sealed container, a refrigerant compressed in a compression mechanism portion.

Heretofore, this type of compressor, for example, a horizontally disposed multistage compression type rotary compressor including a first compression element and a second compression element has been constituted of a driving element disposed in a laterally long cylindrical sealed container, and a compression mechanism portion extended in the horizontal direction of the driving element and including the first and second compression elements which are driven around the rotary shaft of the driving element. Then, a low-pressure refrigerant gas is sucked into the low pressure chamber side of a cylinder from the suction port of the first compression element, compressed by the operations of a roller and a vane to obtain an intermediate pressure, and discharged into the sealed container from a high pressure chamber side through a discharge port and a discharge sound absorbing chamber. The refrigerant gas having the intermediate pressure and discharged into the sealed container is sucked into the low pressure chamber side of the cylinder from the suction port of the second compression element. This refrigerant gas is secondarily compressed by the operations of the roller and the vane, and becomes a high-temperature high-pressure refrigerant gas. This gas is discharged from the compressor via the high pressure chamber side through a discharge port and a discharge sound absorbing chamber.

Moreover, the bottom part of the sealed container is constituted as an oil reservoir, and oil is sucked from the oil reservoir by an oil pump as oil supply means constituted on one end of the rotary shaft, and is supplied to the compression mechanism portion via an oil passage formed in the rotary shaft, to prevent wear on the compression mechanism portion, the sliding portion of the rotary shaft or the like.

In addition, as this type of compressor, a compressor has been developed in which an ejector oil pump is attached to one end of the rotary shaft to supply the oil to the sliding portion by use of an ejector effect produced by the ejector oil pump. That is, the ejector oil pump is constituted of an oil suction pipe having one end connected to the oil passage of the rotary shaft and the other end which opens in the oil reservoir, and an ejector pipe having one end connected to the discharge side of the first compression element and the other end inserted into the opening of the other end of the oil suction pipe. The inner diameter of the other end of the oil suction pipe is larger than the outer diameter of the other end of the ejector pipe so that a gap for oil suction is constituted between both the pipes. Then, the oil of the oil reservoir is sucked into the rotary shaft from the gap for oil suction owing to the ejector effect using the intermediate-pressure refrigerant discharged from the first compression element, and the oil is supplied to the compression mechanism portion via the oil passage in the rotary shaft.

Thus, in the compressor including the first compression element as the first stage and the second compression element as the second stage, a discharge gas amount and a flow rate are determined by the displacement capacity of the second compression element as the second stage. Therefore, the change of the volume of the gas to be discharged from the first compression element is small, so that the oil can stably be supplied to the sliding portion with the ejector oil pump by use of the refrigerant gas discharged from the first compression element (e.g., see Japanese Patent Application Laid-Open No. 2005-36740).

The above conventional compressor has a constitution in which the ejector pipe is simply inserted into the oil suction pipe of the ejector oil pump, so that the dimension, inserting position and the like of the ejector pipe to be inserted into the oil suction pipe have not been defined. However, the gap for oil suction or the like becomes different in accordance with the dimension and position of the ejector pipe to be inserted into the oil suction pipe. In consequence, there has been a problem that the amount of the oil to be sucked by the ejector oil pump becomes remarkably different owing to the variable gap for oil suction or the like, the amount of the oil to be sucked by the ejector oil pump becomes unstable, and the oil cannot stably be supplied to the sliding portion.

SUMMARY OF THE INVENTION

The present invention has been developed in order to solve such a conventional technical problem, and an object thereof is to provide a compressor which stably supplies oil to a sliding portion.

A compressor of the present invention is characterized by: a compressor which is provided with a driving element disposed in a sealed container and a compression mechanism portion driven around the rotary shaft of the driving element and which discharges, into the sealed container, a refrigerant compressed by the compression mechanism portion, the compressor comprising: an ejector oil pump which sucks oil from an oil reservoir in the bottom part of the sealed container to an oil passage formed in the rotary shaft, wherein the ejector oil pump includes an oil suction pipe having one end connected to the oil passage and the other end which opens in the oil reservoir, and an ejector pipe having one end which communicates with the discharge side of the compression mechanism portion and the other end inserted into the opening of the other end of the oil suction pipe to open, the inner diameter of the other end of the oil suction pipe is larger than the outer diameter of the other end of the ejector pipe so that a gap for oil suction is constituted between both the pipes, and the other end of the oil suction pipe is provided with a positioning portion which positions the other end of the ejector pipe.

A compressor according to a second aspect of the invention is characterized in that in the above invention, the compression mechanism portion is constituted of first and second compression elements, the refrigerant compressed by the first compression element is discharged into the sealed container, the discharged refrigerant having an intermediate pressure is compressed by the second compression element and discharged, and one end of the ejector pipe communicates with the discharge side of the first compression element.

A compressor according to a third aspect of the invention is characterized in that the above inventions further comprise a baffle plate which divides, into a driving element side and a compression mechanism portion side, the sealed container in which the driving element and the compression mechanism portion are arranged in a horizontal direction and received, to make a differential pressure, wherein a part of the refrigerant discharged from the compression mechanism portion or the first compression element is discharged to the ejector pipe to suck the oil from the oil reservoir constituted on the compression mechanism portion side of the baffle plate, and the remaining refrigerant is discharged to the driving element side of the baffle plate.

A compressor according to a fourth aspect of the invention is characterized in that in the above inventions, the positioning portion defines, in predetermined ranges, the dimension of the ejector pipe to be inserted into the oil suction pipe and the position of the ejector pipe in the oil suction pipe.

A compressor according to a fifth aspect of the invention is characterized in that in the fourth aspect of the invention, the positioning portion is constituted of a first dowel portion formed in a position on which the other end of the ejector pipe abuts, to determine the length of the ejector pipe to be inserted into the oil suction pipe, and a second dowel portion which abuts on the outer peripheral surface of the ejector pipe to determine the position of the ejector pipe in the diametric direction of the oil suction pipe.

According to the present invention, the compressor is provided with the driving element disposed in the sealed container and the compression mechanism portion driven around the rotary shaft of the driving element, and the compressor discharges, into the sealed container, the refrigerant compressed by the compression mechanism portion. The compressor comprises the ejector oil pump which sucks the oil from the oil reservoir in the bottom part of the sealed container to the oil passage formed in the rotary shaft. This ejector oil pump includes the oil suction pipe having one end connected to the oil passage and the other end which opens in the oil reservoir, and the ejector pipe having one end which communicates with the discharge side of the compression mechanism portion and the other end inserted into the opening of the other end of the oil suction pipe to open, the inner diameter of the other end of the oil suction pipe is larger than the outer diameter of the other end of the ejector pipe so that the gap for oil suction is constituted between both the pipes, and the other end of the oil suction pipe is provided with the positioning portion which positions the other end of the ejector pipe. Therefore, the ejector pipe can securely be inserted into a predetermined position in the oil suction pipe.

Moreover, in addition to the above invention, according to the second aspect of the invention, the compression mechanism portion is constituted of the first and second compression elements, the refrigerant compressed by the first compression element is discharged into the sealed container, this discharged refrigerant having the intermediate pressure is compressed by the second compression element and discharged, and one end of the ejector pipe communicates with the discharge side of the first compression element. Therefore, the oil can stably be sucked and supplied using the refrigerant in which the volume of a gas to be discharged only little changes.

In particular, according to the fourth aspect of the invention, the positioning portion defines, in the predetermined ranges, the dimension of the ejector pipe to be inserted into the oil suction pipe and the position of the ejector pipe in the oil suction pipe. Therefore, as in the fifth aspect of the invention, the positioning portion is constituted of the first dowel portion formed in the position on which the other end of the ejector pipe abuts, to determine the length of the ejector pipe to be inserted into the oil suction pipe, and the second dowel portion which abuts on the outer peripheral surface of the ejector pipe to determine the position of the ejector pipe in the diametric direction of the oil suction pipe, whereby the gap for oil suction can securely be set. Therefore, the positioning portion can set the amount of the oil to be sucked by the ejector oil pump to a desired optimum amount, so that stable oil supply can be realized.

Furthermore, the positioning portion is constituted of the first dowel portion and the second dowel portion as in the fifth aspect of the invention described above, whereby the oil can stably be supplied with a simple constitution.

According to the compressor of the third aspect of the invention, the first or second aspect of the invention further comprises the baffle plate which divides, into a driving element side and a compression mechanism portion side, the sealed container in which the driving element and the compression mechanism portion are arranged in the horizontal direction and received, to make the differential pressure. A part of the refrigerant discharged from the compression mechanism portion or the first compression element is discharged to the ejector pipe to suck the oil from the oil reservoir constituted on the compression mechanism portion side of the baffle plate, and the remaining refrigerant is discharged to the driving element side of the baffle plate. Therefore, the refrigerant discharged to the driving element side makes the differential pressure on the compression mechanism portion side, and an oil level on the compression mechanism portion side of the baffle plate can be raised. In consequence, the opening of the oil suction pipe of the ejector oil pump can be immersed in the oil without any trouble, so that the oil can smoothly be supplied to the sliding portion by the ejector oil pump. Therefore, a preferable oil supply performance can be secured.

DETAILED DESCRIPTION OF THE PREFERRED EMBODIMENT

Figure 1:
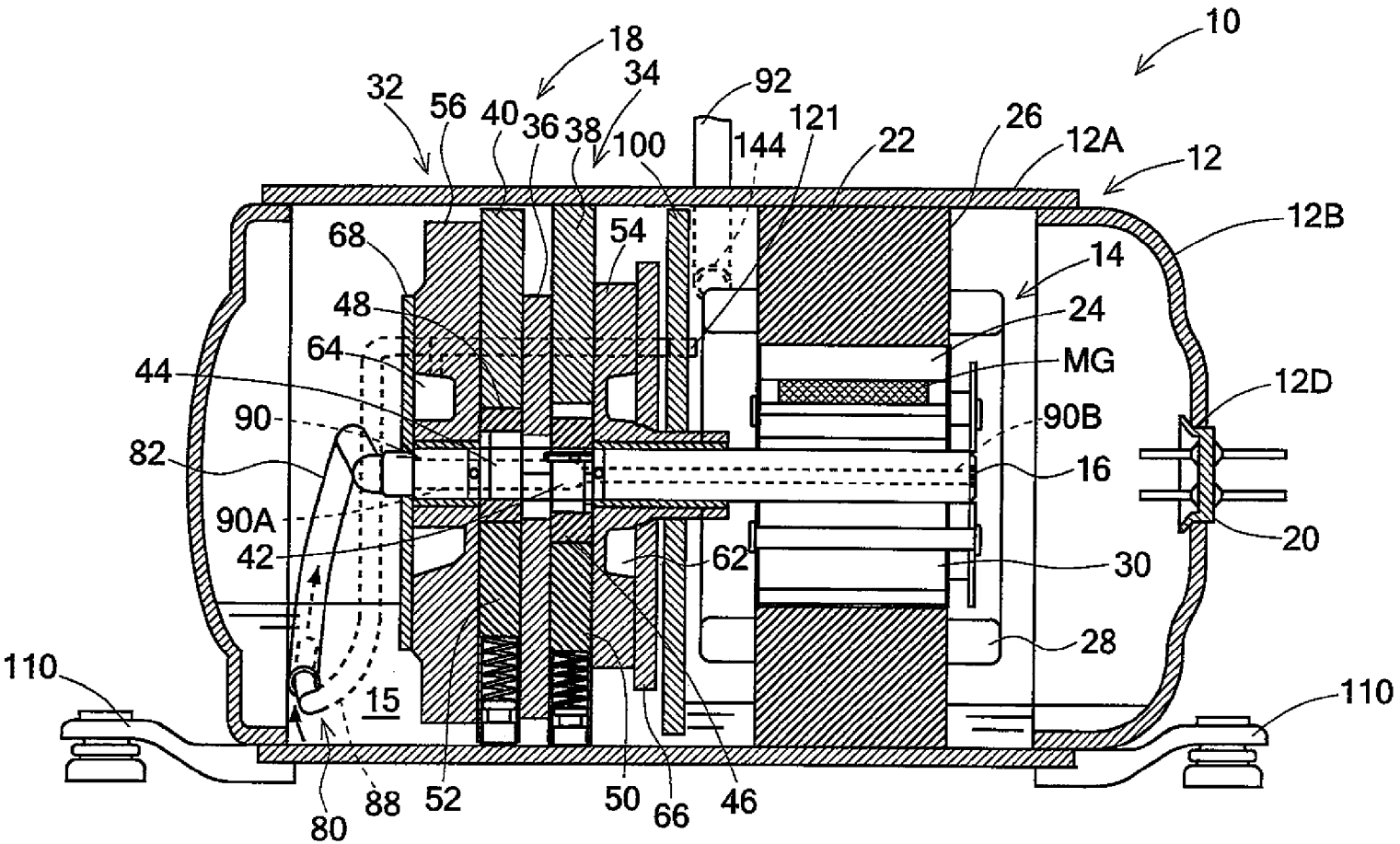
FIG. 1 is a longitudinal front view (corresponding to a section cut along the A-A line of FIG. 4) showing an inner intermediate pressure multistage compression rotary compressor of a horizontally disposed type according to an embodiment of the present invention.
Figure 2:
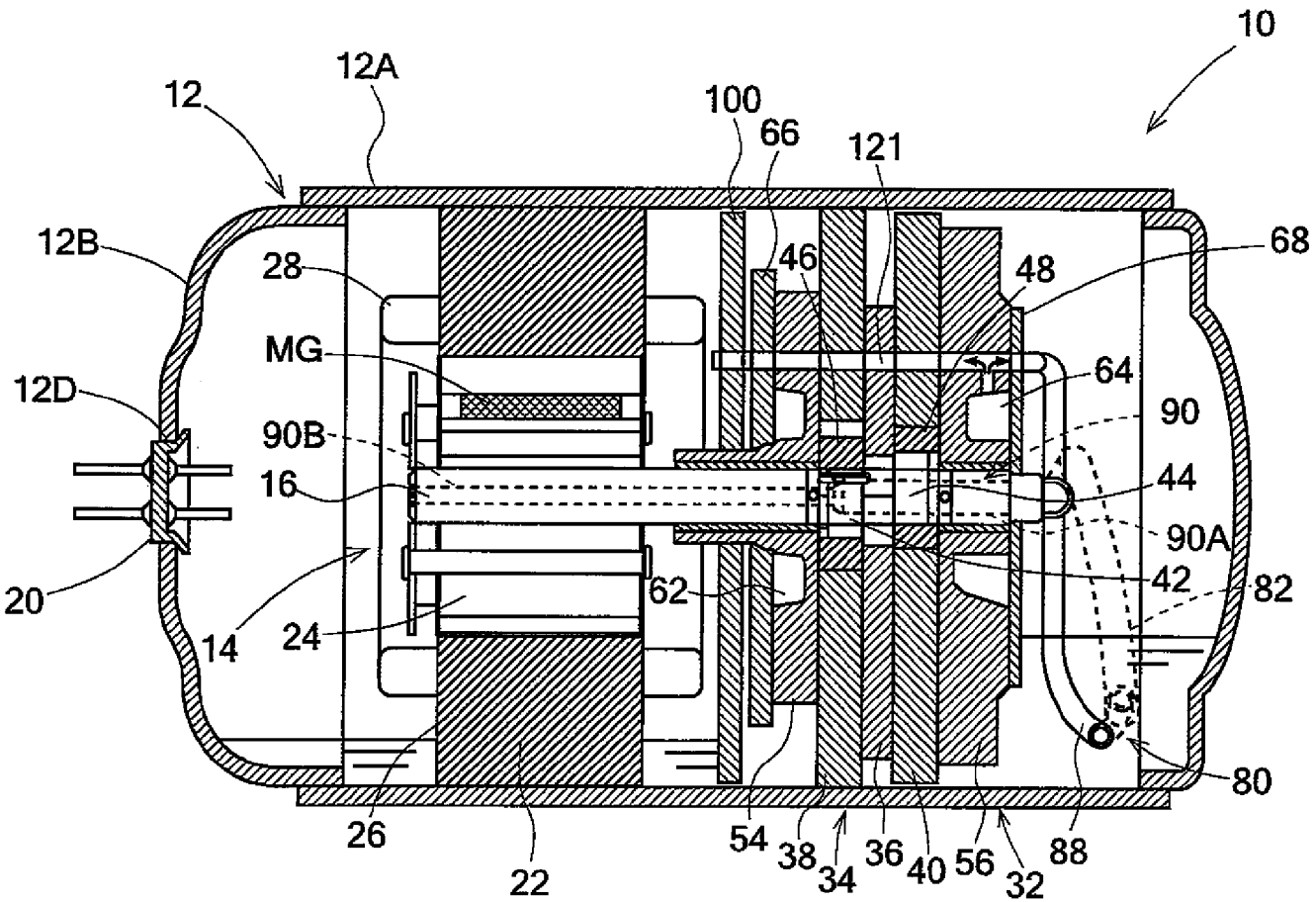
FIG. 2 is a longitudinal front view (corresponding to a section cut along the B-B line of FIG. 4) showing the inner intermediate pressure multistage compression rotary compressor of the horizontally disposed type according to the embodiment of the present invention.
Figure 3:
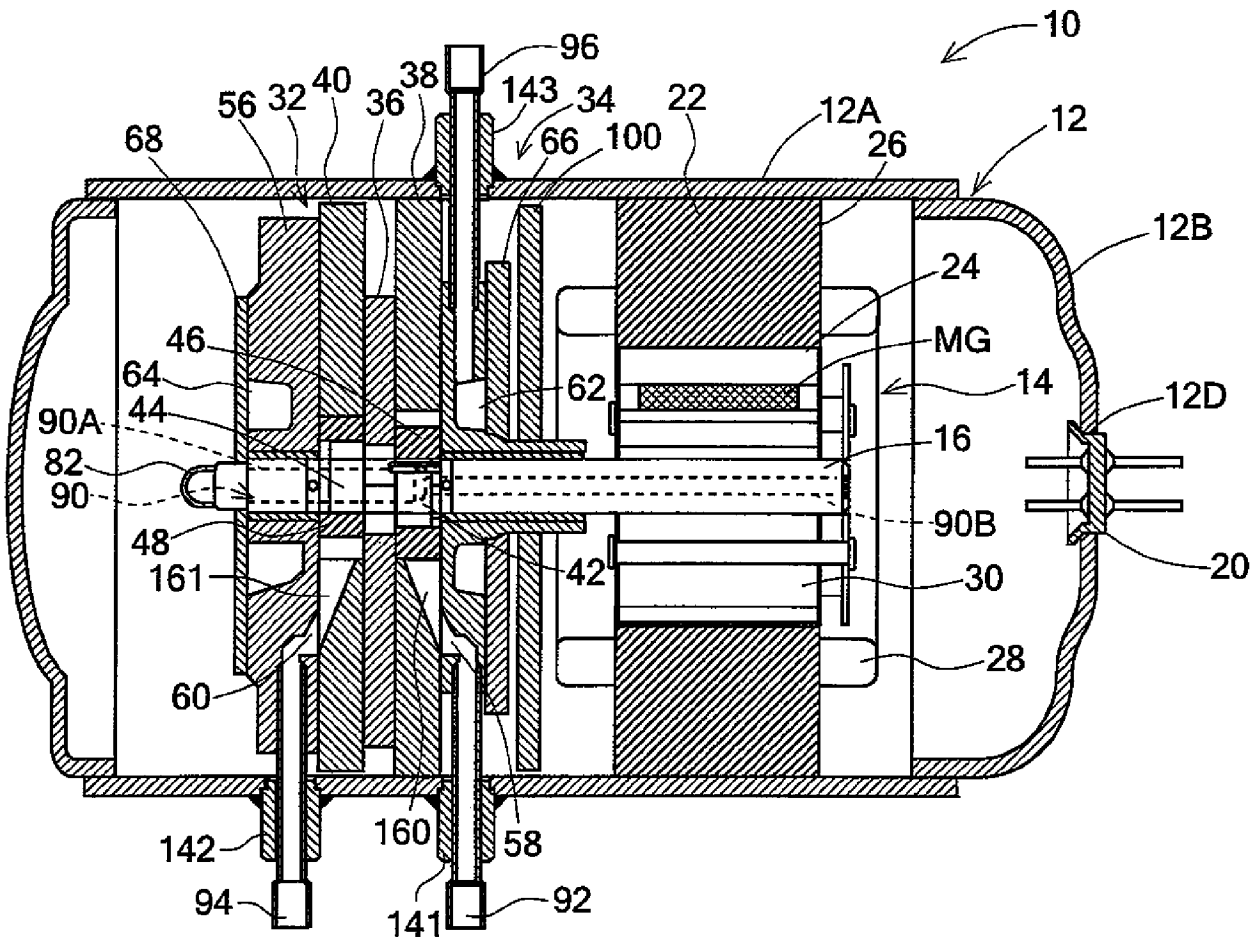
FIG. 3 is a flat sectional view cut along a portion including a refrigerant introduction tube and a refrigerant discharge tube in the inner intermediate pressure multistage compression rotary compressor of the horizontally disposed type according to the embodiment of the present invention.
Figure 4:
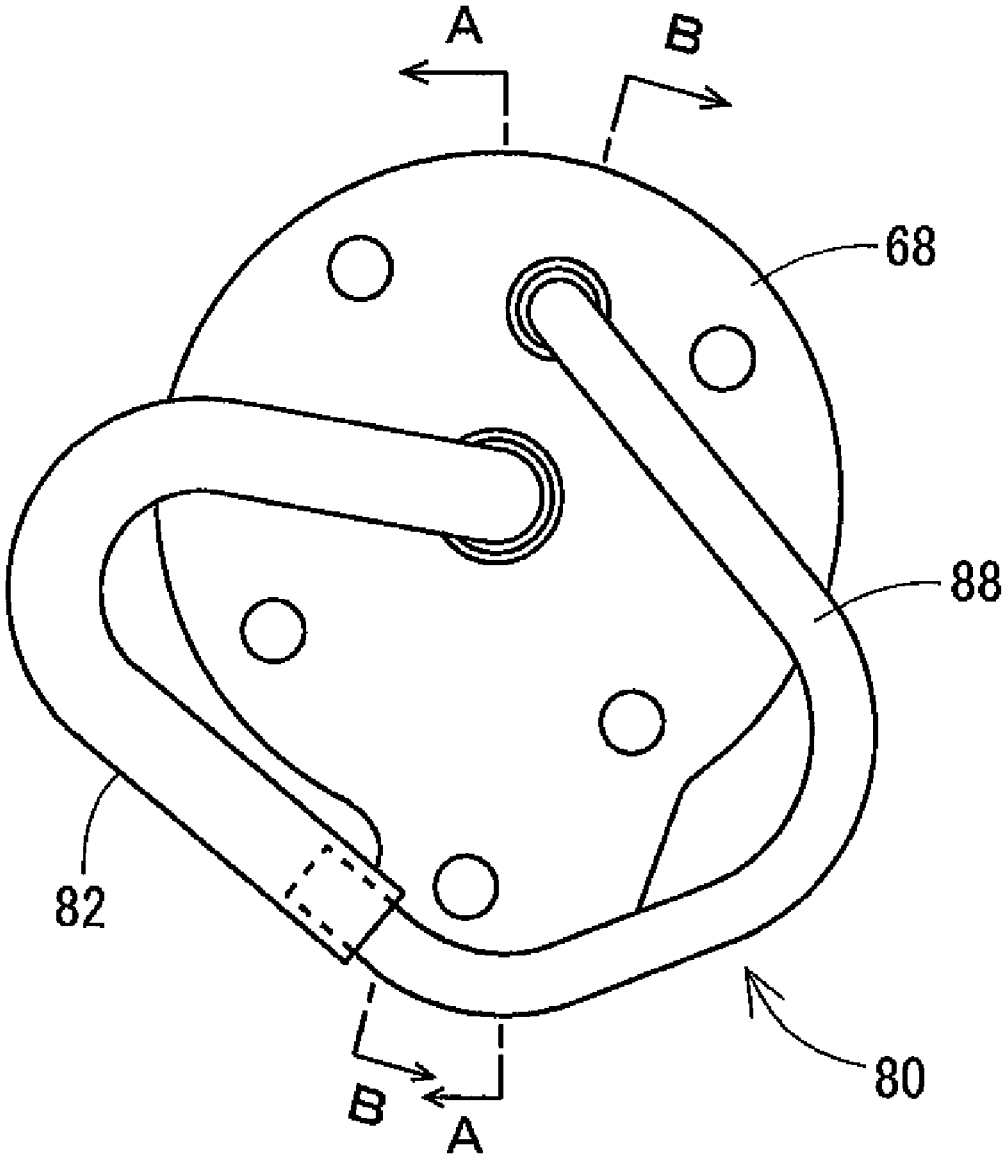
FIG. 4 is a diagram showing an ejector oil pump in the rotary compressor according to the embodiment.

Next, an embodiment of the present invention will be described in detail with reference to the drawings. FIG. 1 is a vertical side view (corresponding to a sectional view cut along the A-A line of FIG. 4 as described later) showing an inner intermediate pressure multistage compression (two-stage) rotary compressor 10 of a horizontally disposed type including first and second compression elements 32, 34 according to an embodiment of a compressor of the present invention. FIG. 2 is another vertical side view (corresponding to a sectional view cut along the B-B line of FIG. 4) showing the multistage compression rotary compressor 10. FIG. 3 is a flat sectional view showing a refrigerant introduction tube and a refrigerant discharge tube in the multistage compression rotary compressor 10. It is to be noted that FIGS. 1 to 3 show sectional views in which a rotary shaft 16 is omitted.

In the drawings, reference numeral 10 is the inner intermediate pressure rotary compressor of the horizontally disposed type. This rotary compressor 10 includes a laterally long cylindrical sealed container 12 having both sealed ends, and the bottom part of this sealed container 12 is an oil reservoir 15. The sealed container 12 is constituted of a container main body 12A and a substantially bowl-like end cap (lid body) 12B which closes the opening in one end of the container main body 12A. A circular attachment hole 12D is formed in the center of the end cap 12B in an axial center direction. A terminal 20 for supplying a power to an electromotive element 14 is attached to the attachment hole 12D.

In the sealed container 12, the electromotive element 14 as the driving element of the rotary compressor 10, and a rotary compression mechanism portion (a compression mechanism portion) 18 driven around the rotary shaft 16 by this electromotive element 14. The electromotive element 14 is received on the side of the end cap 12B of the sealed container 12, and the rotary compression mechanism portion 18 is arranged together with the electromotive element 14 in a horizontal direction (a left-to-right direction in FIG. 1) and received on the side opposite to the end cap 12B.

The electromotive element 14 is constituted of a stator 22 annularly attached along the inner peripheral surface of the sealed container 12, and a rotor 24 inserted and installed on the inner side of the stator 22 with a small space from the stator. This rotor 24 is fixed to the rotary shaft 16 which extends through the center of the sealed container 12 in the axial center direction (the horizontal direction) of the sealed container. An oil passage 90 is formed over an extending direction (the axial center direction) in the rotary shaft 16, and this oil passage 90 includes a large diameter portion 90A having a large diameter on the side of the rotary compression mechanism portion 18, and a small diameter portion 90B having a small diameter on the side of the electromotive element 14.

Moreover, with regard to the inner diameter ratio of the oil passage, when the inner diameter on the side of the large diameter portion 90A is 1, the diameter on the side of the small diameter portion 90B is set to 0.9 to 0.3. That is, in the oil passage 90 provided in the rotary shaft 16, the inner diameter ratio between the large diameter portion 90A and the small diameter portion 90B is set to 1:0.9 to 0.3. The oil passage is constituted so that a large centrifugal force can be applied to a refrigerant gas which has flowed into the large diameter portion 90A and so that oil can be stored. Moreover, one end (the end on the side of the rotary compression mechanism portion 18) of the oil passage 90 of the rotary shaft 16 is connected to one end of an oil suction pipe 82 of an ejector oil pump 80 described later.

The stator 22 has a laminate body 26 in which doughnut-like electromagnetic steel plates are laminated, and a stator coil 28 wound around the teeth portion of this laminate body 26 by a direct winding (concentrated winding) system. Moreover, the rotor 24 is formed of a laminate body 30 including electromagnetic steel plates in the same manner as in the stator 22, and the rotor is formed by inserting a permanent magnet MG into this laminate body 30.

The rotary compression mechanism portion 18 is constituted of the first rotary compression element 32 as a first compression element in a first stage, and the second rotary compression element 34 as a second compression element in a second stage in which a refrigerant compressed by the first rotary compression element 32, discharged into the sealed container 12 and having an intermediate pressure is compressed. The first and second compression elements 32, 34 are constituted of cylinders 38, 40 arranged on both sides (left and right sides in FIG. 1) of an intermediate partition plate 36; rollers 46, 48 which are fitted into eccentric portions 42, 44 provided with a phase difference of 180 degrees on the rotary shaft 16 to eccentrically rotate in the cylinders 38, 40; vanes 50, 52 which abut on these rollers 46, 48 to divide the cylinders 38, 40 into low pressure chamber sides and high pressure chamber sides; and support members 54, 56 which close the open surface of the cylinder 38 on the electromotive element 14 side and the open surface of the cylinder 40 on the side opposite to the electromotive element 14 and which also serve as bearings for the rotary shaft 16, respectively. Moreover, the outer peripheries of the cylinders 38, 40 abut on or come close to the inner surface of the sealed container 12.

On the other hand, the support members 54, 56 are provided with suction passages 58, 60 which communicate with the low pressure chamber sides in the cylinders 38, 40 via suction ports 160, 161, respectively. The suction passage 58 communicates with the inside of the sealed container 12 on the electromotive element 14 side of a baffle plate 100 described later via a refrigerant introduction tube 92, and the refrigerant gas in the sealed container 12 is sucked into the second rotary compression element 34.

Moreover, a part of the support member 54 on the electromotive element 14 side and a part of the support member 56 on the side opposite to the electromotive element 14 are depressed, and the depressed portions are closed with covers 66, 68 to form discharge sound absorbing chambers 62, 64, respectively. These discharge sound absorbing chambers 62, 64 communicate with the cylinders 38, 40 on the high pressure chamber sides via discharge ports (not shown), respectively.

The discharge sound absorbing chamber 64 is connected to the inside of the sealed container 12 on the electromotive element 14 side of the baffle plate 100 via an intermediate discharge tube 121 formed so as to pass through the support member 54, the cylinders 40, 38, the intermediate partition plate 36 and the cover 66 and further pass through the baffle plate 100 provided away from the cover 66. Therefore, the refrigerant gas compressed by the first rotary compression element 32, discharged to the discharge sound absorbing chamber 64 and having the intermediate pressure is discharged into the sealed container 12.

On the other hand, the middle portion of the intermediate discharge tube 121 is connected to an ejector pipe 88 of the ejector oil pump 80. Therefore, one end of this ejector pipe 88 communicates with the inside of the discharge sound absorbing chamber 64 on the discharge side of the first rotary compression element 32 via the intermediate discharge tube 121.

The ejector oil pump 80 sucks oil from the oil reservoir 15 in the bottom part of the sealed container 12 to the oil passage 90 formed in the rotary shaft 16. The ejector oil pump is constituted of the oil suction pipe 82 having one end connected to the oil passage 90 and the other end which opens in the oil reservoir 15, and the ejector pipe 88.

The ejector pipe 88 extends through the cover 68 from one end of the ejector pipe connected to the middle portion of the intermediate discharge tube 121, and lowers toward the bottom part of the sealed container 12, and the other end of the ejector pipe opens in a state in which the other end is slightly inserted into the opening of the other end (the lower end) of the oil suction pipe 82. Furthermore, an outer diameter Sa of the opening of the other end of the ejector pipe 88 inserted into the opening of the other end (the lower end) of the oil suction pipe 82 is formed to be smaller as much as a predetermined dimension than an inner diameter Sb of the other end opening of the oil suction pipe 82. In consequence, in a state in which the other end of the ejector pipe 88 is inserted into the other end opening of the oil suction pipe 82, a predetermined space for oil suction is constituted between the oil suction pipe 82 and the ejector pipe 88. Thus, the end of the ejector pipe 88 including the opening having a small diameter is inserted into the large-diameter opening of the oil suction pipe 82 to form the ejector pipe 88 according to the present invention.

Figure 5:
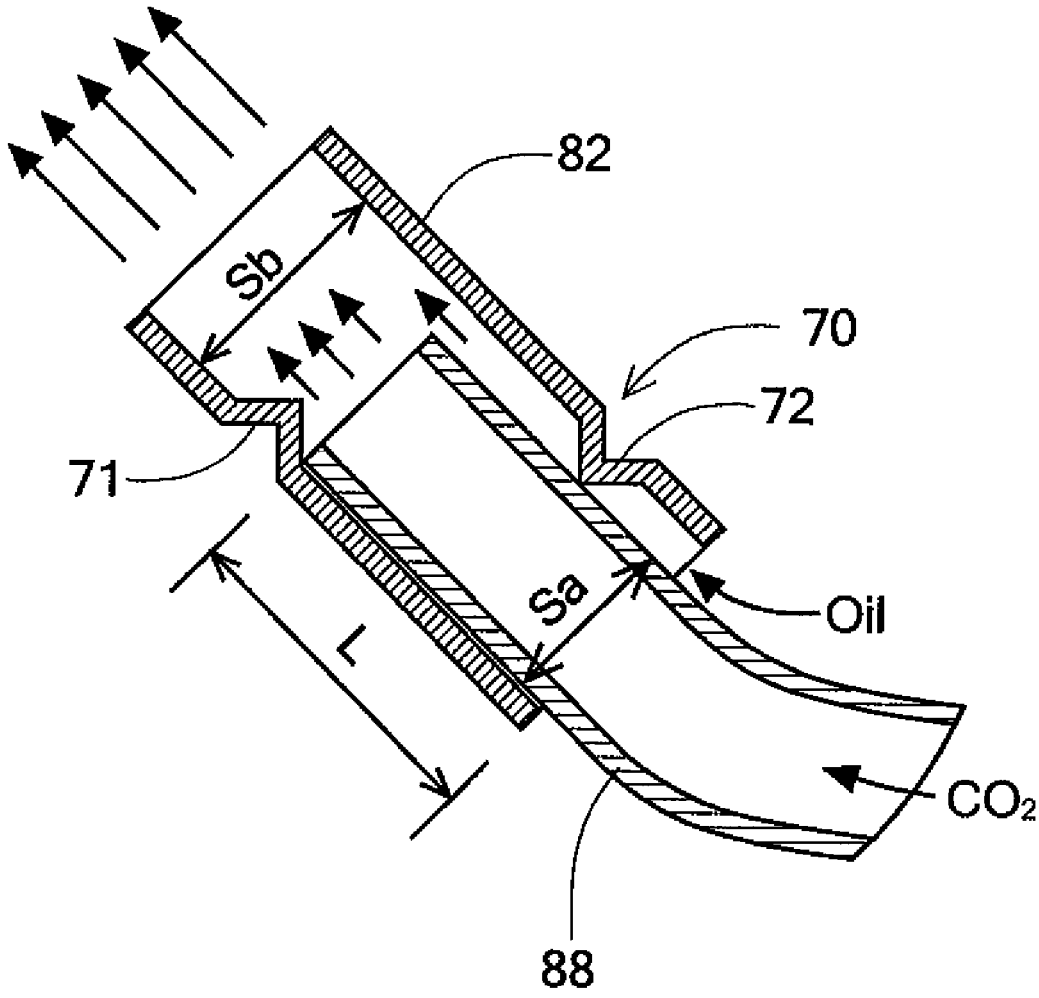
FIG. 5 is a partially enlarged view showing the ejector oil pump of FIG. 4.

Then, the refrigerant gas compressed by the first rotary compression element 32 and discharged into the discharge sound absorbing chamber 64 is branched to the intermediate discharge tube 121 and the ejector pipe 88 to flow into the tube and the pipe (arrows of FIG. 2). Moreover, the refrigerant flowed into the ejector pipe 88, and the refrigerant gas is discharged from the ejector pipe 88 to the oil suction pipe 82, whereby the pressure in a gap between the oil suction pipe 82 and the ejector pipe 88 lowers. In consequence, there is generated an ejector effect that the surrounding oil is sucked from the gap. That is, when the refrigerant gas is discharged from the ejector pipe 88 to the oil suction pipe 82, the oil received in the oil reservoir 15 is sucked into the oil suction pipe 82 from the gap between the oil suction pipe 82 and the ejector pipe 88 by the ejector oil pump 80 (arrows of FIG. 5).

Then, the oil sucked owing to the ejector effect of the ejector oil pump 80 flows through the oil suction pipe 82 together with the refrigerant gas discharged from the ejector pipe 88, and flows into the oil passage 90 of the rotary shaft 16. It is to be noted that a technology for sucking the oil with the ejector oil pump 80 constituted by inserting the small-diameter ejector pipe 88 into the large-diameter oil suction pipe 82 is a heretofore well known technology, and detailed description thereof is omitted.

On the other hand, the other end of the oil suction pipe 82 is provided with a positioning portion 70 for positioning the other end of the ejector pipe 88. The positioning portion 70 defines the dimension of the ejector pipe 88 to be inserted into the oil suction pipe 82 in a predetermined range, and defines the position of the ejector pipe 88 in the oil suction pipe 82 in a predetermined range. The positioning portion 70 of the present embodiment is constituted of a first dowel portion 71 and a second dowel portion 72.

Both the dowel portions 71, 72 are protrusions formed in a convex-like shape toward the inner-diameter direction (the axial center direction of the pipe 82) of the oil suction pipe 82, and the first dowel portion 71 is formed in a position on which the other end of the ejector pipe 88 of the oil suction pipe 82 abuts. In consequence, a length dimension L of the ejector pipe 88 to be inserted into the oil suction pipe 82 is determined. Moreover, the second dowel portion 72 is formed on the side of the other end opening of the oil suction pipe 82 from the first dowel portion 71, and the second dowel portion abuts on the outer peripheral surface of the ejector pipe 88 in a case where the ejector pipe 88 is inserted into the oil suction pipe 82. In consequence, the position of the ejector pipe 88 in the diametric direction of the oil suction pipe 82 is determined.

On the other hand, the above baffle plate 100 divides the sealed container 12 into the electromotive element 14 side and the rotary compression mechanism portion 18 side so that a differential pressure is constituted in the sealed container 12. This baffle plate 100 is constituted of a doughnut-like steel plate arranged with a small space from the inner surface of the sealed container 12. In this case, the refrigerant gas compressed by the first rotary compression element 32, discharged to the electromotive element 14 side in the sealed container 12 and having the intermediate pressure passes through the gap formed between the sealed container 12 and the baffle plate 100 to flow into the rotary compression mechanism portion 18 side. However, owing to the presence of such a baffle plate 100, the differential pressure is constituted in the sealed container 12 so that the pressure on the electromotive element 14 side of the baffle plate 100 is high and the pressure on the compression mechanism portion 18 side is low.

Owing to this differential pressure, the oil received in the oil reservoir in the bottom part of the sealed container 12 moves to the rotary compression mechanism portion 18 side of the baffle plate 100, and an oil level on the rotary compression mechanism portion 18 side rises as compared with the electromotive element 14 side of the baffle plate 100. In this case, the oil reservoir is filled with the oil so that the upper surface of the oil received in the oil reservoir 15 in the bottom part of the sealed container 12 is above as much as a predetermined dimension from at least the lower end of the oil suction pipe 82. In consequence, the lower end of the oil suction pipe 82 including the opening and the ejector pipe 88 inserted into the opening are immersed into the oil without any trouble, so that the oil can smoothly be supplied to the sliding portion of the rotary compression mechanism portion 18 by the ejector oil pump 80.

On the side surface of the sealed container 12, sleeves 141, 142, 143 and 144 are welded and fixed to positions corresponding to the support member 56, the support member 54 and the electromotive element 14 side of the baffle plate 100. Moreover, one end of a refrigerant introduction tube 94 for introducing the refrigerant into the cylinder 40 is inserted into and connected to the sleeve 142 to communicate with the suction passage 60. Then, one end of the refrigerant introduction tube 92 for introducing the refrigerant gas into the cylinder 38 is inserted into and connected to the sleeve 141, and the one end of this refrigerant introduction tube 92 communicates with the suction passage 58 of the cylinder 38.

This refrigerant introduction tube 92 passes on the upside above the sealed container 12 to reach the sleeve 144, and the other end of the refrigerant introduction tube is inserted into and connected to the sleeve 144 to communicate with the upper part of the sealed container 12 on the electromotive element 14 side (between the electromotive element 14 and the baffle plate 100) of the baffle plate 100. Moreover, a refrigerant discharge tube 96 is inserted into the sleeve 143, and one end of this refrigerant discharge tube 96 is connected to the discharge sound absorbing chamber 62. Furthermore, the bottom part of the sealed container 12 is provided with an attachment base 110 (FIG. 1).

Next, the operation of the rotary compressor 10 having the above constitution will be described. When the stator coil 28 of the electromotive element 14 is energized via the terminal 20 and a wiring line (not shown), the electromotive element 14 starts, the rotor 24 rotates, and the rotary shaft 16 also rotates. Owing to this rotation, the rollers 48, 46 fitted into the eccentric portions 44, 42 provided integrally with the rotary shaft 16 eccentrically rotate in the cylinders 40, 38.

In consequence, the refrigerant (low pressure) sucked from the suction port 161 to the low pressure chamber side of the cylinder 40 of the first rotary compression element 32 via the refrigerant introduction tube 94 and the suction passage 60 formed in the support member 56 is compressed by the operations of the roller 48 and the vane 52 to obtain an intermediate pressure. Then, the refrigerant is discharged from the high pressure chamber side of the cylinder 40 to the discharge sound absorbing chamber 64. Then, the refrigerant discharged from the discharge sound absorbing chamber 64 is branched to flow into the ejector pipe 88 and the intermediate discharge tube 121 as described above, and the refrigerant which has flowed into the intermediate discharge tube 121 is discharged to the electromotive element 14 side of the baffle plate 100 in the sealed container 12, so that the intermediate pressure is obtained in the sealed container 12.

On the other hand, the refrigerant which has flowed into the ejector pipe 88 is discharged from the ejector pipe 88 to the oil suction pipe 82. At this time, the pressure of the gap between the oil suction pipe 82 and the ejector pipe 88 lowers, which generates the ejector effect that the surrounding oil is sucked from the gap. That is, when the refrigerant gas is discharged from the ejector pipe 88 to the oil suction pipe 82, the oil received in the oil reservoir 15 is sucked from the gap between the oil suction pipe 82 and the ejector pipe 88 to the oil suction pipe 82 owing to such an ejector effect (arrows in FIG. 5). Then, the oil sucked into the oil suction pipe 82 flows into the refrigerant gas and flows upward in the oil suction pipe 82 to flow into the oil passage 90 in the rotary shaft 16.

The refrigerant gas and oil which have flowed into the oil passage 90 rotate in the oil passage 90 with the rotation of the rotary shaft 16. This rotation produces a centrifugal force, whereby the oil having a mass larger than that of the refrigerant gas is attached to the inner wall of the oil passage 90 and separated from the refrigerant gas. At this time, the large diameter portion 90A having a large diameter is formed on the oil suction pipe 82 side of the oil passage 90, and the small diameter portion 90B having a small diameter is formed on the electromotive element 14 side. Therefore, when the oil flows into the oil passage, the refrigerant gas exerts a large centrifugal force in the large diameter portion 90A of the oil passage 90. Owing to the function of the centrifugal force, the separated oil is urged on the side of the inner wall of the oil passage 90 with a string pressure. Then, the oil urged on the inner wall side of the oil passage 90 flows into an oil passage (not shown) provided in the oil passage 90 of the rotary shaft 16, and is supplied to the sliding portion and the like. In consequence, the oil can stably be supplied to the rotary compression mechanism portion 18, particularly to the sliding portion of the second rotary compression element 34 having a high pressure. Then, the oil supplied to each sliding portion lubricates the sliding portion, and then returns to the oil reservoir 15 in the bottom part of the sealed container 12.

Moreover, the refrigerant gas separated from the oil in the oil passage 90 of the rotary shaft 16 is discharged from the small diameter portion 90B of the oil passage 90 to the electromotive element 14 of the sealed container 12. It is to be noted that the refrigerant gas is substantially present in the center of the rotating rotary shaft 16 (in the oil passage 90), so that the refrigerant gas is smoothly discharged to the electromotive element 14 side of the sealed container 12 without any trouble.

Then, even the oil supplied to each sliding portion and consumed in the oil passage 90 is discharged from the oil passage 90 (the small diameter portion 90B) to the electromotive element 14 side in the sealed container 12 in the same manner as in the refrigerant gas. The oil then flows downwards to the bottom part, and is received in the oil reservoir 15.

On the other hand, the refrigerant gas discharged from the intermediate discharge tube 121 to the electromotive element 14 side of the baffle plate 100 in the sealed container 12 flows through the gap formed between the sealed container 12 and the baffle plate 100 to flow into the rotary compression mechanism portion 18 side. At this time, the refrigerant gas flows through the gap formed between the sealed container 12 and the baffle plate 100. In consequence, owing to the presence of the baffle plate 100, the differential pressure is constituted in the sealed container 12 so that the pressure on the electromotive element 14 side of the baffle plate 100 is high and the pressure on the compression mechanism portion 18 side is low.

Then, owing to this differential pressure, the oil received in the oil reservoir 15 in the bottom part of the sealed container 12 moves to the compression mechanism portion 18 side, and the oil level on the compression mechanism portion 18 side from the baffle plate 100 rises. In this case, the oil reservoir is filled with the oil so that the upper surface of the oil received in the oil reservoir 15 in the bottom part of the sealed container 12 is above as much as the predetermined dimension from at least the lower end of the oil suction pipe 82. In consequence, the open lower end of the oil suction pipe 82 of the ejector oil pump 80 is immersed into the oil without any trouble, so that the oil can smoothly be supplied to the sliding portion of the compression mechanism portion 18 by the ejector oil pump 80.

Thus, the lower end of the oil suction pipe 82 including the opening and the ejector pipe 88 connected to the opening can be immersed into the oil. In consequence, the refrigerant gas having the intermediate pressure in the sealed container 12 is not sucked by the ejector oil pump 80, and only the oil received in the oil reservoir 15 can be sucked and smoothly supplied to the sliding portion of the rotary compression mechanism portion 18.

Then, the intermediate-pressure refrigerant gas in the sealed container 12 flows into the refrigerant introduction tube 92, flows through the upside above the sealed container 12, and is sucked from the suction passage 58 to the low pressure chamber side of the cylinder 38 of the second rotary compression element 34 via the suction port 160. Then, the intermediate-pressure refrigerant gas sucked on the low pressure chamber side of the cylinder 38 is secondarily compressed by the operations of the roller 46 and the vane 50, and becomes a high-temperature high-pressure refrigerant gas.

The high-temperature high-pressure refrigerant gas flows through a discharge port (not shown) from the high pressure chamber side, flows through the discharge sound absorbing chamber 62 formed in the support member 54, and is discharged from the rotary compressor 10 via the refrigerant discharge tube 96.

Thus, the above rotary compressor 10 includes the ejector oil pump 80 which sucks the oil from the bottom part of the sealed container 12 to the oil passage 90 of the rotary shaft 16 owing to the ejector effect of the refrigerant discharged from the first rotary compression element 32 as shown in the longitudinal side view. In the rotary compressor 10, the amount of the gas to be discharged and the flow rate are determined in accordance with the displacement capacity of the second rotary compression element 34, so that the volume of the gas to be discharged from the first rotary compression element 32 changes only little. In consequence, the stable effect of the ejector oil pump 80 can be obtained, and the oil can stably be sucked and supplied with the ejector oil pump 80.

Moreover, the oil on the compression mechanism portion 18 side of the baffle plate 100 is sucked with the ejector oil pump 80 using a part of the refrigerant gas discharged from the first rotary compression element 32, and the remaining refrigerant gas is discharged to the electromotive element 14 side of the baffle plate 100, so that the refrigerant discharged to the electromotive element 14 side can constitute the differential pressure from the compression mechanism portion 18 side. In consequence, the oil level on the compression mechanism portion 18 side of the baffle plate 100 can be raised, so that a preferable oil supply performance can be secured.

In particular, the positioning portion 70 for positioning the other end of the ejector pipe 88 is constituted, so that the ejector pipe 88 can securely be inserted into the predetermined position of the oil suction pipe 82.

Furthermore, the positioning portion 70 defines, in the predetermined ranges, the dimension of the ejector pipe 88 to be inserted into the oil suction pipe 82 and the position of the ejector pipe 88 in the oil suction pipe 82. As in the present embodiment, the positioning portion 70 is constituted of the first dowel portion 71 formed in the position on which the other end of the ejector pipe 88 abuts to determine the length of the ejector pipe 88 to be inserted into the oil suction pipe 82, and the second dowel portion 72 which abuts on the outer peripheral surface of the ejector pipe 88 to determine the position of the ejector pipe 88 in the diametric direction of the oil suction pipe 82. In consequence, the gap for oil suction can securely be set. Therefore, the positioning portion 70 determines the position of the ejector pipe 88 to be inserted into the oil suction pipe 82 so that the amount of the oil to be sucked by the ejector oil pump 80 is a desired optimum amount, so that stable oil supply can be realized.

Furthermore, the positioning portion 70 is constituted of the first dowel portion 71 and the second dowel portion 72, whereby the oil can stably be supplied with a simple constitution. Moreover, the ejector pipe 88 is fixed to the predetermined position in the oil suction pipe 82, whereby a disadvantage that the ejector pipe 88 moves can be eliminated.

As described above in detail, according to the rotary compressor 10 of the present invention, the oil can stably be supplied to the sliding portion by use of the ejector oil pump 80.

It is to be noted that according to the fifth aspect of the invention, the positioning portion 70 is constituted of the first dowel portion 71 formed in the position on which the other end of the ejector pipe 88 abuts, to determine the length of the ejector pipe 88 to be inserted into the oil suction pipe 82, and the second dowel portion 72 which abuts on the outer peripheral surface of the ejector pipe 88 to determine the position of the ejector pipe 88 in the diametric direction of the oil suction pipe 82. However, this is not restrictive. According to the first to fourth aspects of the invention, the positioning portion may be formed on the other end of the oil suction pipe 82, and may position the other end of the ejector pipe 88. According to the fourth aspect of the invention, there is not any special restriction on the positioning portion as long as the dimension of the ejector pipe 88 to be inserted into the oil suction pipe 82 and the position of the ejector pipe 88 in the oil suction pipe 82 are defined in the predetermined ranges.

It is to be noted that the application of the present invention to the two-stage compression rotary compressor 10 of the horizontally disposed type has been described, but this is not restrictive, and the present invention may be applied to a vertically disposed type compressor. Moreover, there is not any problem even in a case where the present invention is applied to a compressor in which a compressor rear portion is constituted of a single-stage compression element or a multistage compressor constituted of three or more stages of compression elements. Even in this case, an effect similar to that of the present embodiment can be obtained.

What is claimed is:

1. A compressor which is provided with a driving element disposed in a sealed container and a compression mechanism portion driven around a rotary shaft of the driving element and which discharges, into the sealed container, a refrigerant compressed by the compression mechanism portion, the compressor comprising:

an ejector oil pump which sucks oil from an oil reservoir in the bottom part of the sealed container to an oil passage formed in the rotary shaft, wherein the ejector oil pump includes an oil suction pipe having one end connected to the oil passage and the other end which opens in the oil reservoir, and an ejector pipe having one end which communicates with the discharge side of the compression mechanism portion and the other end inserted into the opening of the other end of the oil suction pipe to open, an inner diameter of the other end of the oil suction pipe is larger than an outer diameter of the other end of the ejector pipe so that a gap for oil suction is constituted between both the pipes, and the other end of the oil suction pipe is provided with a positioning portion which positions the other end of the ejector pipe, wherein the positioning portion defines, in predetermined ranges, the dimension of the ejector pipe to be inserted into the oil suction pipe and the position of the ejector pipe in the oil suction pipe, and wherein the positioning portion is constituted of a first dowel portion formed in a position on which the other end of the ejector pipe abuts, to determine the length of the ejector pipe to be inserted into the oil suction pipe, and a second dowel portion which abuts on the outer peripheral surface of the ejector pipe to determine the position of the ejector pipe in the diametric direction of the oil suction pipe.

2. The compressor according to claim 1, wherein the compression mechanism portion is constituted of first and second compression elements, the refrigerant compressed by the first compression element is discharged into the sealed container, the discharged refrigerant having an intermediate pressure is compressed by the second compression element and discharged, and one end of the ejector pipe communicates with the discharge side of the first compression element.

3. The compressor according to claim 1, further comprising:

a baffle plate which divides, into a driving element side and a compression mechanism portion side, the sealed container in which the driving element and the compression mechanism portion are arranged in a horizontal direction and received, to make a differential pressure, wherein a part of the refrigerant discharged from the compression mechanism portion or the first compression element is discharged to the ejector pipe to suck the oil from the oil reservoir constituted on the compression mechanism portion side of the baffle plate, and the remaining refrigerant is discharged to the driving element side of the baffle plate.

* * * * *